US005639985A

United States Patent [19]

Garner et al.

[11] Patent Number: 5,639,985

[45] Date of Patent: Jun. 17, 1997

[54] GROOVE DRAG MITIGATION

[75] Inventors: James M. Garner, Aberdeen; Harris L. Edge, Havre de Grace, both of Md.

[73] Assignee: The United States of America as represented by the Secretary of the Army, Washington, D.C.

[21] Appl. No.: 707,361

[22] Filed: Sep. 4, 1996

[51] Int. Cl.[6] ..... F42B 14/06

[52] U.S. Cl. ..... 102/521; 102/293; 102/490; 102/517; 244/3.1

[58] Field of Search ..... 102/520–527, 102/293, 501, 517, 490; 244/3.1

[56] References Cited

U.S. PATENT DOCUMENTS

| | | | |
|---|---|---|---|
| 3,992,997 | 11/1976 | McCubbin et al. | 102/481 |
| 4,156,752 | 5/1979 | Riccitiello et al. | 428/220 |
| 4,658,728 | 4/1987 | Amos et al. | 102/501 |
| 4,941,244 | 7/1990 | Ortmann et al. | 102/521 |
| 5,227,580 | 7/1993 | Berville et al. | 102/521 |

*Primary Examiner*—Harold J. Tudor

*Attorney, Agent, or Firm*—Freda L. Krosnick; William E. Eshelman

[57] ABSTRACT

To mitigate groove drag in a kinetic energy projectile, an intumescent material is inserted in the grooves wherein the material will expand to fill the grooves once the sabot has been discarded. The groove material inhibits aerodynamic recirculation that can occur in the grooves, fills the groove and keeps out freestream gasses. The expanding groove material occupies the space previously filled by the sabot tooth. The groove-filling material expands quickly, because the flight of the projectile is typically on the order of one to two seconds. The groove filling material may also be an elastic material.

7 Claims, 2 Drawing Sheets

GROOVE DRAG MITIGATION

BACKGROUND OF THE INVENTION

The present invention relates in general to aerodynamic drag reduction and, in particular, to aerodynamic drag reduction in kinetic energy projectiles.

Aerodynamic drag reduction is an important factor in improving the performance of projectiles. A substantial drag component for long-rod kinetic energy (KE) penetrators is the skin friction drag. This component is typically responsible for anywhere from a third to a half of the total drag.

The skin friction drag is affected by the characteristics of the flow pattern over the body. Exposed projectile body grooves, which allow a sabot to hold on to and drive a projectile, affect the flow and often create more drag than a smooth body would. Scientists have examined the effect and have created computer programs to predict groove drag components for various projectile configurations. Increases in drag, due to projectile grooves, can be on the order of 10% of the total drag for Mach numbers near 3.5. See Mikhail, A. "Incremental Drag Due to Grooves and Threads for KE Projectiles." BRL-TR-2982, U.S. Army Ballistic Research Laboratory, Aberdeen Proving Ground, Md., March 1989.

As increasing length-over-diameter (L/D) projectiles are required, the amount of grooves required to launch them may increase groove drag further. It is possible that covers could be fabricated that slide over the grooves once the sabot has discarded. Unfortunately, these covers would be required to move into position and lock in place. This would be a difficult task in a high Mach number environment and would likely involve substantial projectile modification, significant development costs, and time expenditures.

A system of flow modification using "intumescent" materials requires no moving parts, and is actuated by the free-flight temperature conditions. Additionally, it requires only minor projectile modifications.

SUMMARY OF THE INVENTION

It is an object of the present invention to reduce the aerodynamic drag of a kinetic energy projectile.

This and other objects of the invention are achieved by a projectile comprising a projectile body having at least one groove or indentation formed therein; and an intumescent material disposed in the at least one groove or indentation.

Preferably, the intumescent material is Material 513.

In another aspect, the inventive projectile comprises a projectile body having at least one groove or indentation formed therein; an elastic material disposed in the at least one groove or indentation; and a sabot connected to the projectile at the groove.

The invention also encompasses a method of reducing drag of a projectile comprising aerodynamically heating intumescent material; generating gas from the intumescent material; and expanding the intumescent material to at least partially fill space in at least one groove or indentation in the projectile body.

The invention further includes a method of reducing drag of a projectile comprising launching the projectile; removing a sabot from the projectile body; and expanding an elastic material disposed in a groove in the projectile body.

Other objects, features and advantages of the invention will become apparent from the following detailed description taken in conjunction with the accompanying drawings.

DETAILED DESCRIPTION OF THE PREFERRED EMBODIMENTS

Figure 1:
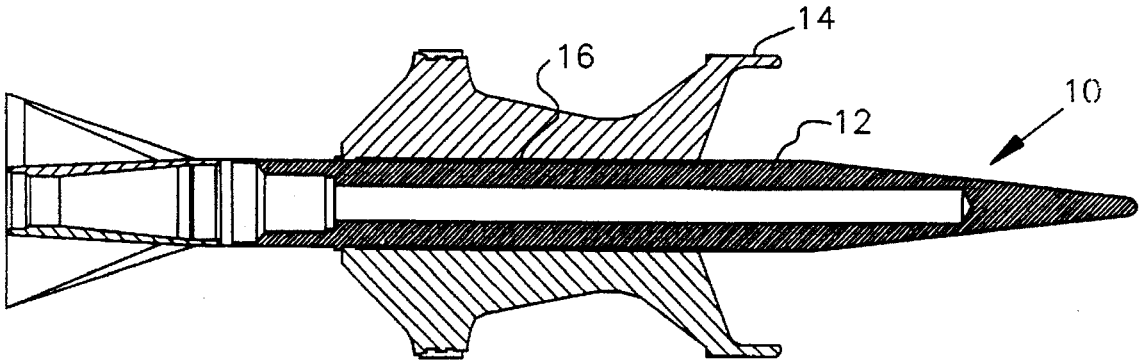
FIG. 1 shows a kinetic energy (KE) projectile.

Minimizing groove drag is more advantageous at particular Mach numbers. State-of-the-art KE ordnance, whose flight is typically in the Mach 5-4 regime, will see a relatively small benefit (1–3% reduction). Saboted projectiles with trajectories in the Mach 4-3 regime will probably reap a 5–10% reduction. Trajectories with Mach numbers less than 2.5 will see smaller reductions. A typical projectile and sabot combination is shown in FIG. 1.

In an effort to mitigate groove drag, the present invention includes a material inserted in the grooves wherein the material will expand to fill the grooves once the sabot has been discarded. This should inhibit aerodynamic recirculation that can occur in the grooves. Ideally, the material fills the groove and keeps out freestream gasses. The expanding material occupies the space previously filled by the sabot tooth. While it is unlikely that the material will expand to the exact height required to form a smooth cylinder, a reduction in the groove depth will offer some drag benefit.

Figure 2:
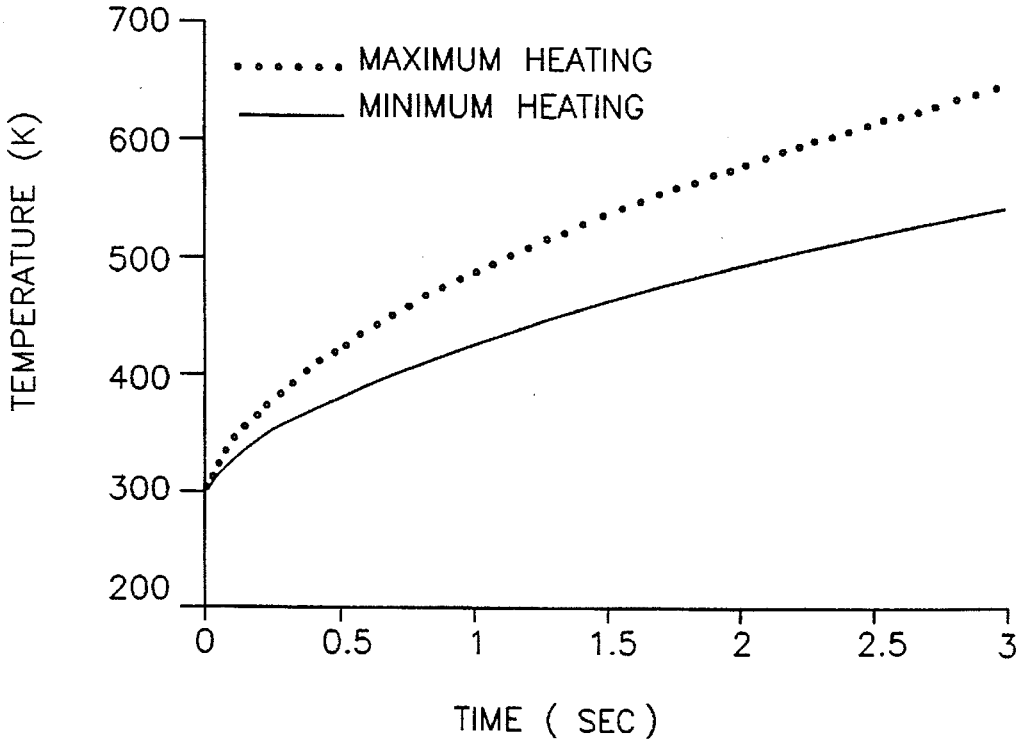
FIG. 2 is a graph of a groove heating profile showing temperature as a function of time.

The groove-filling material expands quickly, since the flight of the projectile is typically on the order of 1–2 seconds. The material must expand quickly to be of significance. FIG. 2 shows predictions of the temperature profile for a KE penetrator groove. The profile suggests that groove temperatures around 125° C. could realistically be expected after 0.5–1.0 seconds of flight.

Presently, groove drag is an accepted penalty for the benefit of using grooved projectiles. In the past, there was no easy manner of reducing the grooves' drag effect. Specialized materials and more complete knowledge of the projectile's environment allow a practical solution.

The inventive groove fill system is activated by aerodynamic heating load generated in flight and conducted to the fill material. The fill material expands to many times (5–10) its original thickness and outgasses during its pyrolytic reaction under the heat load. The material expansion and outgassing effects act as deterrents to prevent the freestream gasses from entering the groove region. The materials for this application are, for example, termed "intumescent."

Applying the groove fill concept to a projectile flight may require that, for example, the projectile grooves are cut deeper to accommodate fill material. Additionally, there may have to be some surface preparation in the area of the grooves to help the coating adhere.

Some chemical tailoring of the intumescent materials is likely to achieve the necessary performance. The reaction time of the coating and expansion ratio are important performance parameters. The coating material is similar in nature to a paint. Expansion ratios can vary from 2 to 60 times the application thickness. There are a variety of intumescent mixtures, and their expansion ratios are linked to their composition as well as the amount of heat they encounter.

Given this, a specific mixture may be particularly suited to the in-flight temperatures (125°–250° C.) of a particular projectile's grooves. The expansion of the material is due to the generation of gas within the coating. Rapid expansions, on the order of one half a second, are possible given the proper material mixtures. Ultimately, a char forms as the reaction propagates through the coating thickness. The process absorbs heat through phase changes, and the resulting char serves as an insulator.

A candidate formulation of an available intumescent material ( See Anderson, C. E. Jr., D. Ketchum, and W. Mountain. "Thermal Conductivity of Intumescent Chars." Southwest Research Institute, San Antonio, Tex., November 1988) is as follows:

Formulation 513

| | bisphenol A epoxy resin |
|---|---|
| EPON 828 (trademark) | 21.7% |
| Polysulfide | 21.3% |
| | tris(dimethylaminomethyl)phenol |
| DMP-30 | 3.2% |
| Borax | 52.9% |

Its expansion performance is as follows:

| Mixture | Unreacted | Reacted |
|---|---|---|
| 513-1AA | 0.155 cm | 1.43 cm |

The components listed for the formulation are very stable and will not have any appreciable reaction under 49° C. The material's lack of volatility should make it suitable for long-term storage. The composition of the intumescents indicates that their production should be inexpensive. The intumescents' viscosity will help them to adhere in place while drying.

An alternative embodiment is to position an elastic material in the groove bottom wherein the elastic material compresses when the projectile package is assembled and then expands once the projectile is fired. A foam rubber material that can expand to adequately fill the grooves is also an option.

Figure 3:
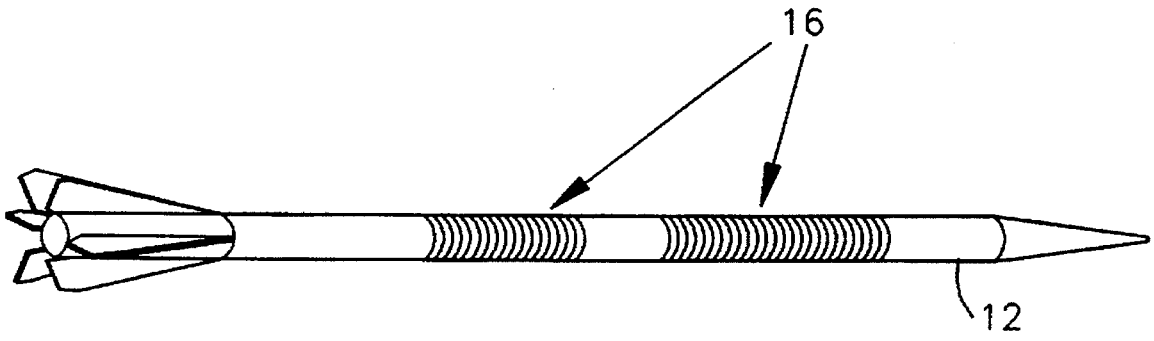
FIG. 3 shows a projectile body with grooves.

As shown in FIG. 1, a KE projectile 10 comprises a sabot 14 and a projectile body 12. FIG. 3 illustrates a projectile body 12 and its grooves 16. The sabot 14 (FIG. 1) normally grips the projectile body 12 via a system of meshing grooves 16 and teeth (on the sabot).

Normally, when the projectile body 12 and sabot 14 are in place, the projectile groove 16 is not entirely filled by the sabot tooth, and a small space remains at the bottom of the groove 16. The groove filling (intumescent) material 18 is placed in this region before the sabot 14 is put in place. Once the sabot 14 is attached, it shields the groove-fill material 18 from scratching or chipping during handling. After launch, as the sabot 14 discards, the projectile groove 16 temperature rises, the fill material 18 reacts and expands, and gas begins to effuse from the groove region.

Figure 4:
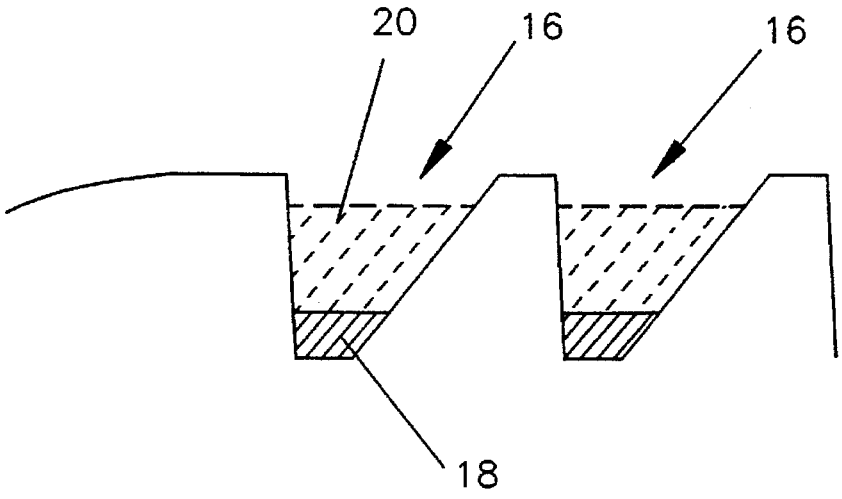
FIG. 4 is an enlarged view of a groove.

FIG. 4 is an enlarged view of two grooves 16 and shows where the unreacted fill material 18 resides, as well as the space the reacted material 20 (phantom lines) occupies. While expanding, the fill material 18 effuses gas that affects the projectile drag. After a brief period (less than a second), the material 18 has essentially finished reacting and is expanded closer to the groove height. For the remainder of the flight, the projectile 10 will more closely approximate the aerodynamic characteristics of a smooth cylinder in the grooved region.

The invention presented offers a practical way to reduce the groove drag without substantially altering the structure of the groove or involving any moving parts. The invention uses basic chemical mechanisms to create a material that expands and generates gas flow to positively impact the projectile drag. While finely grooved large L/Ds seem to be a natural application for this technology, it may more broadly be applied to any projectile with shallow voids.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A projectile, comprising:

a projectile body having at least one groove or indentation formed therein;

a sabot attached to the projectile body at the at least one groove or indentation; and an intumescent material which partially fills the at least one groove or indentation prior to the projectile being launched and which expands and remains within the at least one groove or indentation during flight of the projectile.

2. The projectile of claim 1, wherein the intumescent material is comprised of about 21.7% bisphenol, A epoxy resin, about 21.3% polysulfide, about 3.2% tris (dimethylaminomethyl) phenol and about 52.9% borax Material [513].

3. A projectile, comprising:

a projectile body having at least one groove or indentation formed therein;

an elastic material disposed in the at least one groove or indentation; and a sabot connected to the projectile body at the at least one groove or indentation;

wherein the sabot compresses the elastic material prior to the projectile being launched and, after the sabot is discarded, the elastic material expands and remains within the at least one groove or indentation during flight of the projectile.

4. The projectile of claim 3, wherein the elastic material is a foam rubber.

5. A method of reducing drag of the projectile of claim 1, comprising:

launching the projectile;

removing the sabot from the projectile body;

aerodynamically heating the intumescent material;

generating gas from the intumescent material; and expanding the intumescent material to at least partially fill space in the at least one groove or indentation during the flight of the projectile.

6. The method of claim 5, further comprising forming a char from the intumescent material.

7. A method of reducing drag of the projectile of claim 3, comprising:

launching the projectile;

removing the sabot from the projectile body; and expanding the elastic material to at least partially fill space in the at least one groove or indentation during the flight of the projectile.

* * * * *